US005188076A

United States Patent [19]

Alvarez-Avila et al.

[11] Patent Number: 5,188,076

[45] Date of Patent: Feb. 23, 1993

[54] FUEL INJECTION PUMP FOR INTERNAL COMBUSTION ENGINES

[75] Inventors: Carlos Alvarez-Avila, Freiberg/N; Karl-Friedrich Ruesseler, Renningen; Helmut Tschoeke, Ostfildern; Karl Konrath, Freiberg/Neckar, all of Fed. Rep. of Germany

[73] Assignee: Robert Bosch GmbH, Stuttgart, Fed. Rep. of Germany

[21] Appl. No.: 883,003

[22] Filed: May 14, 1992

[30] Foreign Application Priority Data

May 27, 1991 [DE] Fed. Rep. of Germany ..... 4117267

[51] Int. Cl.[5] ..... F02D 31/00

[52] U.S. Cl. ..... 123/357; 123/373; 123/368

[58] Field of Search ..... 123/503, 449, 373, 357, 123/368

[56] References Cited

U.S. PATENT DOCUMENTS

| | | | |
|---|---|---|---|
| 4,373,994 | 3/1983 | Lang | 123/368 |
| 4,414,945 | 11/1983 | Bonin | 123/368 |
| 4,526,146 | 7/1985 | Djordjevic et al. | 123/357 |
| 4,615,317 | 10/1986 | Bofinger et al. | 123/373 |
| 4,656,980 | 4/1987 | Ohkoshi | 123/373 |
| 4,685,433 | 8/1987 | Djordjevic | 123/357 |
| 4,703,730 | 11/1987 | Eheim et al. | 123/449 |
| 4,711,205 | 12/1987 | Ito | 123/449 |
| 4,729,357 | 3/1988 | Freudenschuss et al. | 123/357 |
| 4,791,901 | 12/1988 | Eheim | 123/449 |
| 4,836,165 | 6/1989 | Kubota et al. | 123/357 |
| 4,887,569 | 12/1989 | Igashira et al. | 123/300 |
| 4,887,571 | 12/1989 | Eheim et al. | 123/357 |
| 4,920,938 | 5/1990 | Schwarz et al. | 123/373 |
| 5,036,815 | 8/1991 | Augustin et al. | 123/357 |
| 5,080,063 | 1/1992 | Augustin | 123/357 |
| 5,086,739 | 2/1992 | Fränkle | 123/357 |

FOREIGN PATENT DOCUMENTS

| | | | |
|---|---|---|---|
| 0378737 | 7/1990 | European Pat. Off. | 123/368 |
| 0170542 | 7/1988 | Japan | 123/368 |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel injection pump for internal combustion engines having a fuel injection quantity adjusting device, in which by the imposition of a stepping motor and by varying a spring assembly at the adjusting device, not only can the starting and full-load injection quantities be controlled but the idling injection quantity can also be regulated as a function of engine operating parameters.

20 Claims, 2 Drawing Sheets

FUEL INJECTION PUMP FOR INTERNAL COMBUSTION ENGINES

BACKGROUND OF THE INVENTION

The invention is based on a fuel injection pump having an adjusting device. In a fuel injection pump of this type, known from German Offenlegungsschrift 32 43 349, a two-armed lever, which is adjustable by an electrically controlled stepping motor, displaces a tensioning lever via a stop, counter to the force of a governor spring. By the force of a centrifugal governor, a two-armed starting lever, which is connected to an annular slide of a fuel quantity adjusting device, comes to rest on this tensioning lever. With this arrangement, only the full-load injection quantity can be determined as a function of operating parameters. For an optimal course of combustion, various injection quantities are needed in all the various engine operating states. This is especially true for governing engine idling, where turning on additional equipment of the motor vehicle, such as hydraulic pumps, air conditioning systems and electric motors for various functions, and temperature factors, can cause increased power consumption. In order nevertheless to keep the engine rpm constant at as low a level as possible given these fluctuations in power consumption, the injection quantity must be governed as a function of engine operating parameters, which cannot be done in the prior art described.

OBJECT AND SUMMARY OF THE INVENTION

The fuel injection pump according to the invention has the advantage over the prior art that not only the known full-load control, but also idling governing and control of the starting quantity, are done as a function of the engine operating state. Governing the injection quantity individually is thus possible in all engine operating states. Moreover, in the fuel quantity metering in the fuel injection pump according to the invention, various types of engine operation, such as with supercharging, altitude correction, or temperature equalization, can be taken into account with little effort or expense.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
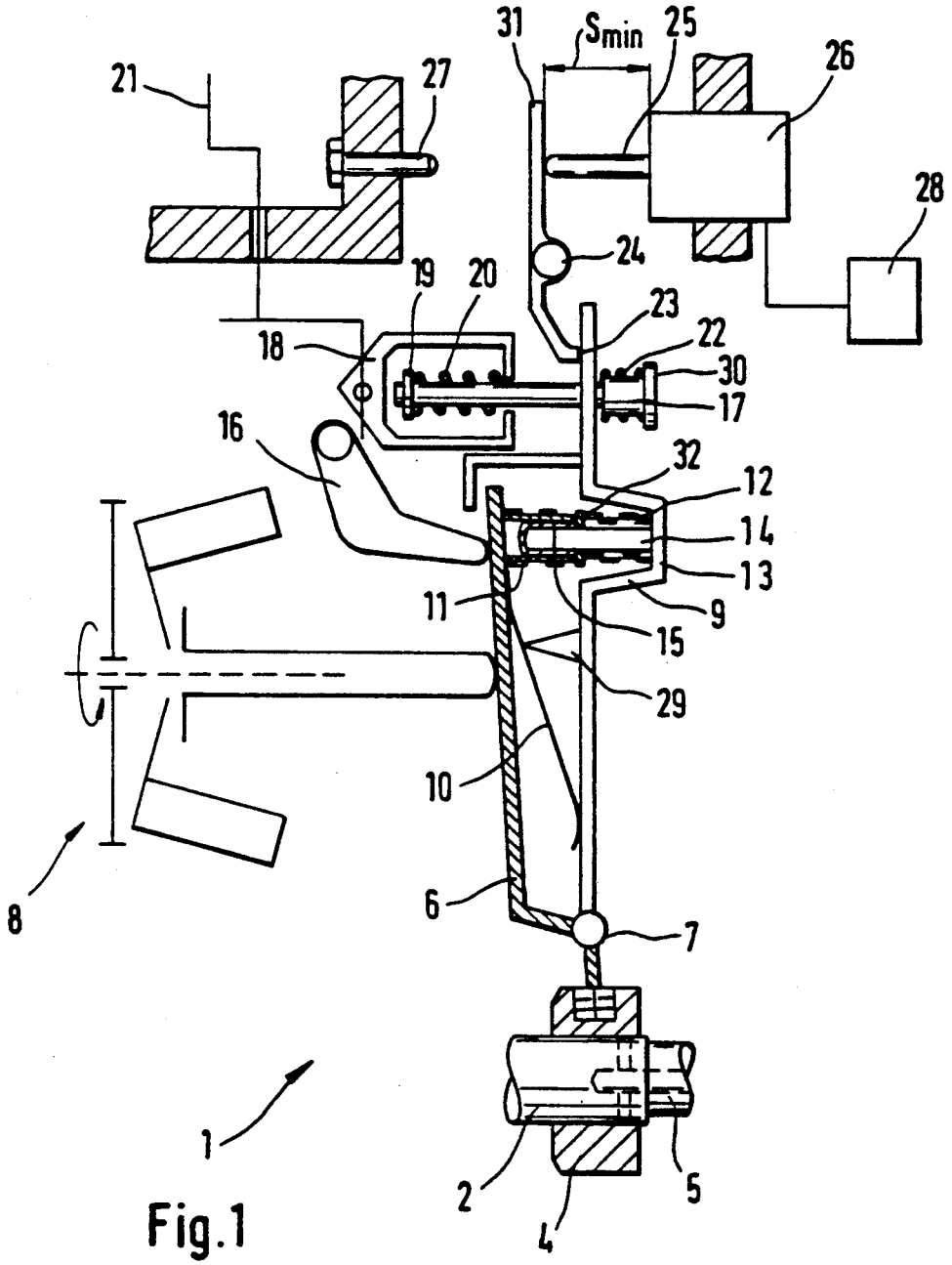
FIG. 1 shows the exemplary embodiment upon engine starting, with a two-armed lever serving as an adjustable stop.
Figure 2:
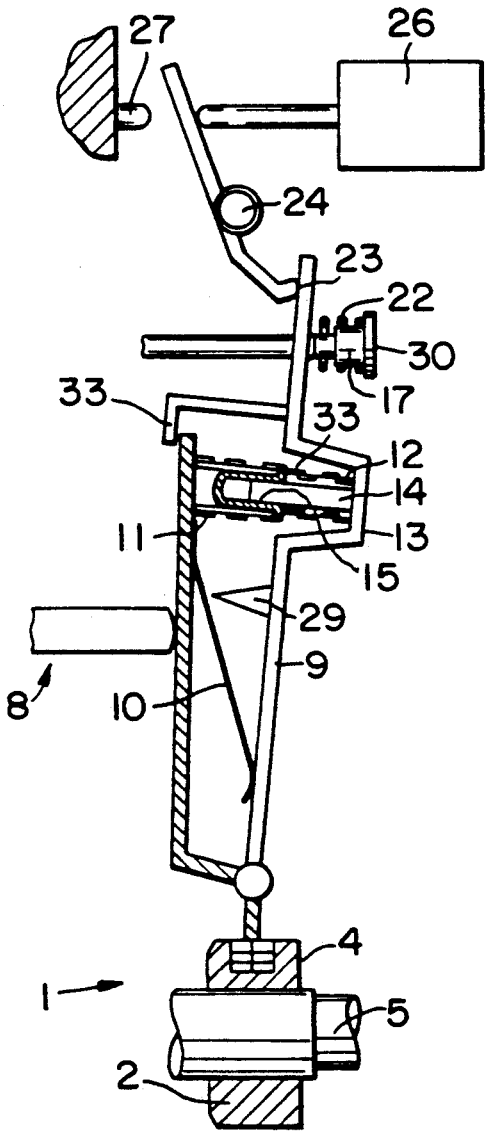
FIG. 2 shows the exemplary embodiment during engine idling.
Figure 3:
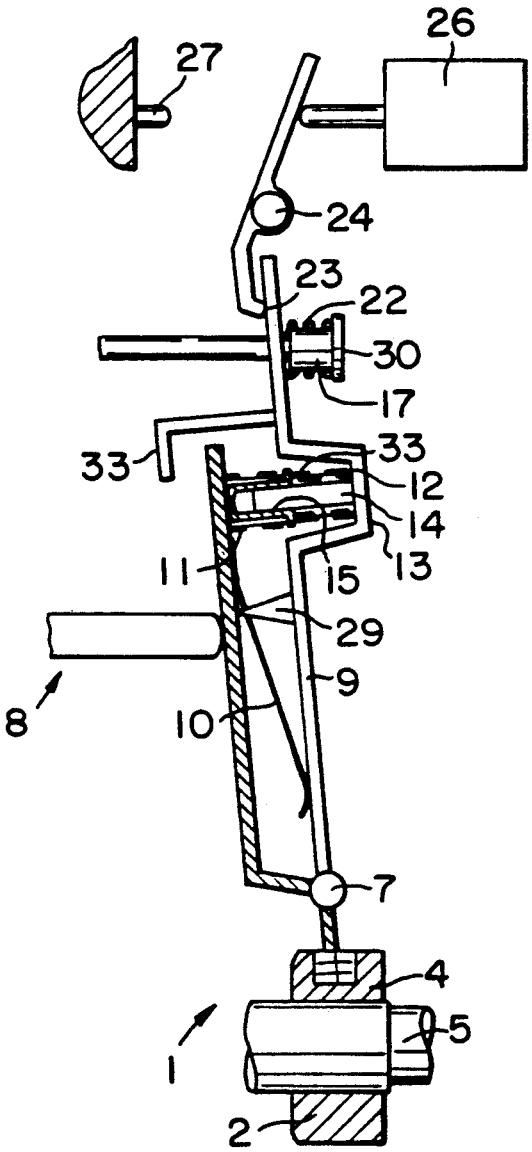
FIG. 3 shows the position of the adjustable stop in the full-load state of the engine.

FIG. 1 is a simplified view, partially cut away, of a fuel injection pump 1 of the distributor type. These pumps have a reciprocating and simultaneously rotating pump piston 2, which as it rotates opens various fuel outlets so as to supply engine fuel injection points. The fuel quantity is controlled by an annular slide 4, serving as a fuel quantity adjusting device, the edge of which controls a relief conduit 5, disposed in the pump piston 2, of the pump work chamber (not shown). Opening this conduit, because it relieves the pump work chamber, interrupts the injection of fuel. The annular slide 4 is connected to an angled starting lever 6, which can be swiveled about a shaft 7 attached to the housing and includes a spherical end piece on one arm which engages a recess of the annular slide 4. A speed governor 8, shown in simplified form and preferably embodied as a centrifugal governor, which is driven synchronously with the pump rpm, engages the starting lever 6 with an rpm-dependent force. By means of the speed governor 8, the starting lever 6 counter to the restoring force of a starting spring 10 can be made to contact a tensioning lever 9, in the form of a one-armed lever, which can be swiveled about the shaft 7 of the starting lever 6 and on which the starting spring 10, embodied as a leaf spring is supported. An idling spring 11 and an intermediate spring 12, which are embodied as helical compression springs, are disposed in line with one another between the tensioning lever 9 and the starting lever 6. For accommodating these springs, the tensioning lever 9 has an offset bend 13, inside which a pin 14 protrudes at right angles from the tensioning lever 9; a spring plate 32 provided with a sleeve 15 is guided on the pin 14; the idling spring 11 engages the starting lever side of the spring plate, and the intermediate spring 12 engages the spring plate on the tensioning lever side. When the centrifugally influenced starting lever 6 is pressed against the tensioning lever 9, a precision-manufactured stop can be disposed on one of the two levers 6, 9 which serves as a contact point; the pin 14, with a precision manufactured stop, serves merely to guide the spring assembly, but as shown in the exemplary embodiment can also take on this function. Within the swiveling range of the starting lever 6, an adjustable stop lever 16 is disposed on the side of the speed governor B on which the starting lever 6 comes to rest upon cold engine starting, under the influence of the starting spring 10 in the starting position, and with which the initial position of the starting lever 6 and thus the starting injection quantity can be adjusted, regardless of the initial position of the speed governor 8. This stop lever 16 thus takes on not only its function for shutting off the engine by adjusting the starting lever 6 and thus the annular slide 4 in the direction of zero supply, but also takes on the function of basic setting of increased fuel quantity in cold starting. The starting lever 9 has a bore on its free end, through which a bolt 17 is guided that is engaged via a spring plate 19, toward the starting lever, by a governor spring 20 fastened between this spring plate 19 and a connecting part 18; the connecting part 18 is connected to an adjusting lever 21 located outside the fuel injection pump, via an eccentric or a lever arm. On the other end, the bolt has a head 30, and a tensioning spring 22 embodied as a compression spring disposed between the head 30 and the tensioning lever 9; in the starting position of the tensioning lever 9 and adjusting lever 21, the tensioning spring 22 is compressed to such an extent that the head 30 comes to rest on the tensioning lever 9. The tensioning lever 9 is then in contact with a stop 23, which is embodied on one lever arm end of a two-armed lever 31. This two-armed lever 31 can be swiveled with the stop 23 about a shaft 24 attached to the housing; the swiveling motion is generated by a control element 25, engaging the other lever arm end, of a stepping motor 26. The adjusting travel of the adjusting element 25 in the direction of the lever 31 is limited by a stop 27, which is adjustable and which for instance can be embodied by the shape of a screw that penetrates the pump housing wall and can be turned from outside. Various terminal positions of the adjusting device 25 and thus of the two-armed lever 31 are thus possible. The stepping motor 26 is controlled by a control unit 28, which in accordance with a control value formed from engine operating parameter outputs directed to the stepping motor 26. Advantageously, each time before the engine is started, the adjusting device 25 is moved as far as the adjustable stop 27, so that after that the adjusting device can be moved from this fixed reference point to the control value to be set. As the stepping motor, either a linear stepping motor or a rotary stepping motor can be used; if a rotary stepping motor is used, the shaft of the stepping motor can drive a threaded spindle serving as the control element 25; the adjusting forces that the stepping motor must overcome can be reduced considerably by this provision. FIGS. 2 and 3 show the same structure as FIG. 1 in simplified form, but for other operating states. They are intended above all to explain the processes taking place in the various operating states.

In cold engine starting as shown in FIG. 1, the position of the stop lever 16 determines the initial position of the starting lever 6, and thus the position of the annular slide 4 in which the maximum fuel quantity comes to be injected. Via the head 30, the tensioning lever 9 is pressed against the stop 23, which has been moved by the stepping motor 26 into its starting position corresponding to the full-load position, which thus also determines the maximum possible injection quantity during the starting process as well, as a function of the engine temperature. The tensioning spring 22 is bypassed, because the governor spring 20 has greater rigidity and initial tension than the tensioning spring 22. As the rpm increases, the speed governor 8 immediately comes into contact with the starting lever 6, since there is no restoring force. Upon starting, the starting quantity is thus attained, and the pump piston 2 covers a long useful stroke until the cutoff point. Even a low rpm suffices to cause the speed governor 8 to become operative, which then displaces the starting lever 6 counter to the soft starting spring 10 until the idling spring comes into operation; in this process the starting lever 6 rotates around the shaft 7 attached to the housing and displaces the annular slide in the direction of a smaller injection quantity. When a warm engine is started, the stepping motor 26 directs the tensioning lever 9 in the direction remote from the speed governor 8, via the adjustable stop 23. The starting lever 6 is then pressed by the starting spring 10 against a means for limiting gaping of the tensioning lever 9, which means forms a starting quantity stop 33 for the increased fuel quantity. In warm starting, the increased fuel quantity is thus controlled as a function of engine temperature, via the starting quantity stop 33 on the tensioning lever 9.

In FIG. 2, the fuel quantity adjusting device is in the position of the engine idling state; the stop 23 displaces the tensioning lever 9 in the direction remote from the governor spring 20 and thus prevents the starting lever 6 from resting on the tensioning lever 9. The speed governor 8 at the same time presses the starting lever 6 toward the tensioning lever 9, counter to the force of the idling spring 11 and intermediate spring 12, and the tensioning lever 9 in turn is supported via the tensioning spring 22 on the head 30 of the retaining bolt 17, as a result of which an equilibrium of forces is established. The position of the annular slide 4 is accordingly determined by the cooperation of centrifugal force and the force of the springs 10, 11, 12, and 22; the governor spring 20, along with the bolt 17 and the part 18, is displaced toward the tensioning spring 22. In the lower idling range, the idling spring 11 governs the fuel quantity, while in the upper idling range, in which the idling spring 11 is bypassed and the sleeve 15 is brought into contact with the starting lever 6 by the intermediate spring 12 via a spring plate 32, the intermediate spring 12 becomes operative. With the two springs, a wide idling and transitional range can thus be regulated; various governing characteristic curves are attainable via various spring rigidities. The tensioning spring 22 on the collar of the bolt 17 has the task of keeping the tensioning lever 9 in contact with the stop 23 that is adjustable by the stepping motor 26; to that end, it has a greater spring rigidity than the springs 11, 12 and a lesser spring rigidity than the governor spring 20. Now if a heavy load is transmitted in the idling range, for instance because several additional units are in use, this is picked up via sensors and passed on to the control unit 28, which then passes adjustment signals on to the stepping motor 26. The stepping motor then adjusts the tensioning lever 9, via the two-armed lever 31 and the stop 23 located on the two armed lever, in such a way that the tensioning lever assumes the outset position necessary, for this load, for maintaining the constant idling rpm or some higher rpm. The reference position of the tensioning lever 9 is the basic setting at which speed regulation begins during idling, and the rpm-dependent speed governing limit is determined by the stop 29. The connecting part 18 and thus the governor spring 20 and the retaining bolt 17 are always in the idling position during idling; that is, the entire speed governing is performed automatically by the adjusting device, and a balance of forces is always established between the force of the speed governor 8 and that of the spring assembly 11, 12. If a change in engine operating state is needed, then the stepping motor 26 thereupon adjusts the stop 23 via the two-armed lever 31. Similarly, if the load on the engine changes, the basic idling setting and thus the instant of speed governing during idling can be varied via the stepping motor 26.

FIG. 3 shows the adjusting device in full load operation. The tensioning spring 22 is bypassed by the adjusting force of the speed governor 8 counter to the stronger governor spring 20, and the head 30 of the retaining bolt 17 rests directly on the tensioning lever 9. The intermediate, starting and idling springs 12, 10, 11 are bypassed, and the starting lever 6 rests on the pin 14 of the tensioning lever 9, which is thus coupled to the starting lever 6 in the adjusting direction of the speed governor 8. In the connecting part 18, the governor spring 20 is prestressed by a certain amount, which corresponds to the adjusting force of the speed governor 8 at the maximum allowable rpm. If there should now be a requirement for more power output by the engine, then via the adjusting lever 21 and the prestressed governor spring 20, the tensioning lever and at the same time the annular slide 4 are displaced in the direction of a greater supply quantity. If engine relief occurs and the speed rises while the fuel injection pump supply quantity remains the same, then when the maximum rpm is attained and the governor spring prestressing is overcome, the speed governor 8 presses the annular slide 4 back in the direction of decreasing supply quantity, via the starting lever 6. Only once the prestressing of the governor spring 20 has been overcome by the effect of the speed governor 8 does this terminal speed control become effective. The full-load stop 23 thus limits the maximum injection quantity during engine operation, which as a rule is less than the starting quantity. By means of the stepping motor 26, the full-load stop 23 can now be adjusted as a function of operating parameters, with its position adjusted via the two-armed lever 31. The most important advantage, however, besides the temperature-dependent starting quantity control and the avoidance of clouds of smoke, is the idling speed control. Here, a constant or an elevated constant idling rpm can be maintained regardless of the supplementary units that may be turned on and regardless of the engine temperature. In particular, it is possible to specify a lower idling rpm during normal engine operation, which in turn favorably affects the load on the engine itself, its pollutant emissions, the noise it produces, and its fuel consumption.

The foregoing relates to a preferred exemplary embodiment of the invention, it being understood that other variants and embodiments thereof are possible within the spirit and scope of the invention, the latter being defined by the appended claims.

WHAT IS CLAIMED AND DESIRED TO BE SECURED BY LETTERS PATENT OF THE UNITED STATES IS:

1. A fuel injection pump for internal combustion engines having a fuel quantity adjusting device that is adjustable via an adjusting governor, wherein the adjusting device (6, 9) is adjustable by an rpm-dependent force (8) counter to the force of a governor spring (20) and by means of an adjustable second stop (23), on which the adjusting device is retained by the force of a tensioning spring (22) and which with its adjusted position determines the maximum quantity of fuel attaining injection, wherein the adjustable second stop (23) is adjustable by stepping motor (26) controlled in accordance with engine operating parameters, the stepping motor (26), and the adjustable second stop (23) serves not only to limit the full-load injection quantity and to adjust the starting quantity but also to govern an idling injection quantity.

2. A fuel injection pump as defined by claim 1, in which the adjusting device comprises a two-armed starting lever (6) and a one-armed tensioning lever (9), against which the starting lever (6) can be made to rest under the influence of the rpm-dependent force (8), a starting spring (10) and an idling spring assembly (11 and 12) are disposed between said two-armed starting lever (6) and said one-armed tensioning lever (9), and said tensioning spring (22) in series with the governor spring (20), by which the tensioning lever (9) is acted upon in a direction of the adjustable second stop (23).

3. The fuel injection pump as defined by claim 1, in which the starting lever travel is limited by a third stop (33) connected to the tensioning lever (9).

4. The fuel injection pump as defined by claim 2, in which the starting lever travel is limited by a third stop (33) connected to the tensioning lever (9).

5. The fuel injection pump as defined by claim 1, in which the governor spring (20) is a pre-stressed spring, one support face of said pre-stressed governor spring (20) cooperates with an adjusting lever (21) and one other support face which is a head (30) of a bolt (17) which passes through an end of the tensioning lever (9), the tensioning spring (22), embodied as a compression spring is disposed, between the head (30) of the bolt (17) and the tensioning lever (9), and the spring travel of said tensioning spring (22) is limited by the contact of the head (30) with the tensioning lever (9).

6. The fuel injection pump as defined by claim 2, in which the governor spring (20) is a pre-stressed spring, one support face of said pre-stressed governor spring (20) cooperates with an adjusting lever (21) and one other support face which is a head (30) of a bolt (17) which passes through an end of the tensioning lever (9), the tensioning spring (22), embodied as a compression spring is disposed, between the head (30) of the bolt 17 and the tensioning lever (9), and the spring travel of said tensioning spring (22) is limited by the contact of the head (30) with the tensioning lever (9).

7. The fuel injection pump as defined by claim 2, in which the idling spring assembly (11 and 12) comprises two series-connected compression springs, and these springs have different spring rigidities.

8. The fuel injection pump as defined by claim 4, in which the idling spring assembly (11 and 12) comprises two series-connected compression springs, and these springs have different spring rigidities.

9. The fuel injection pump as defined by claim 6, in which the idling spring assembly (11 and 12) comprises two series-connected compression springs, and these springs have different spring rigidities.

10. The fuel injection pump as defined by claim 7, in which a spring plate (32), is disposed between the compression springs (11 and 12) from which a support sleeve (15) extends that can be brought into contact with a starting lever (16).

11. The fuel injection pump as defined by claim 8, in which a spring plate (32), is disposed between the compression springs (11 and 12) from which a support sleeve (15) extends that can be brought into contact with a starting lever (16).

12. The fuel injection pump as defined by claim 9, in which a spring plate (32), is disposed between the compression springs (11 and 12) from which a support sleeve (15) extends that can be brought into contact with a starting lever (16).

13. The fuel injection pump as defined by claim 10, in which the support sleeve (15) is guided on a pin (14) that is connected to (6) the tensioning lever (9).

14. The fuel injection pump as defined by claim 11, in which the support sleeve (15) is guided on a pin (14) that is connected to (6) the tensioning lever (9).

15. The fuel injection pump as defined by claim 12, in which the support sleeve (15) is guided on a pin (14) that is connected to (6) the tensioning lever (9).

16. The fuel injection pump as defined by claim 13, in which the pin (14) serves as a contact surface of (6) the tensioning lever (9).

17. The fuel injection pump as defined by claim 2, in which the compression springs (11 and 12) do not become effective until after an adjustment of the starting lever (6) counter to the starting spring (10).

18. The fuel injection pump as defined by claim 1, in which the adjustable second stop (23) is disposed on a second two-armed lever (31), which is moved counter to an adjustable fourth stop (27) by an adjusting element (25) of the stepping motor (26) before each starting of the engine.

19. The fuel injection pump as defined by claim 2, in which the adjustable second stop (23) is disposed on a second two-armed lever (31), which is moved counter to an adjustable fourth stop (27) by an adjusting element (25) of the stepping motor (26) before each starting of the engine.

20. The fuel injection pump as defined claim 10, in which the stop lever (16), which is disposed in the swiveling range of the starting lever (6), determines the initial position of the starting lever when the engine is cold, regardless of the rpm-dependent force (8).

* * * * *